United States Patent [19]

Grimes

[11] Patent Number: 4,884,992

[45] Date of Patent: Dec. 5, 1989

[54] COIN-DISPENSING APPARATUS

[76] Inventor: Michael L. Grimes, 320 B Catalina Dr., Newport Beach, Calif. 92663

[21] Appl. No.: 199,808

[22] Filed: May 27, 1988

[51] Int. Cl.[4] ..... G07D 1/08; G07D 9/04

[52] U.S. Cl. ..... 453/29; 221/24; 221/207; 453/56

[58] Field of Search ..... 453/29, 36, 37, 39, 453/42, 44, 45, 46, 49, 56, 63; 194/342, 343; 124/47, 49, 50, 79; 221/206, 207, 253, 266, 24; 446/11; 222/79

[56] References Cited

U.S. PATENT DOCUMENTS

| | | | |
|---|---|---|---|
| 1,026,755 | 5/1912 | Lundin | 453/56 X |
| 1,889,472 | 11/1932 | Godefroid | 453/56 X |
| 3,191,588 | 6/1965 | Thew | 221/281 X |
| 3,194,249 | 7/1965 | Lonke et al. | 194/343 |
| 3,438,547 | 4/1969 | Pereida et al. | 222/79 |
| 3,786,683 | 1/1974 | Berman et al. | 222/79 X |
| 4,094,129 | 6/1978 | List | 221/253 X |
| 4,462,414 | 7/1984 | Gordon | 453/44 |

*Primary Examiner*—F. J. Bartuska

*Attorney, Agent, or Firm*—Harvey C. Nienow

[57] ABSTRACT

Coin-dispensing apparatus having a general shape of a hand gun and provided with a trigger for manually advancing an endless belt formed with coin receptacles or pockets for receiving coins as they are fed by gravity from a reservoir, such advancing endless belt moving such coins to an outlet of the apparatus where such coins are directed into a coin-receiving machine such as a slot machine or the like. The apparatus is attachable to such coin-receiving machine and includes an adjustable cam member whereby the number of coins dispensed by the apparatus with a single actuation of the trigger can be varied within limits.

7 Claims, 2 Drawing Sheets

FIG. 6
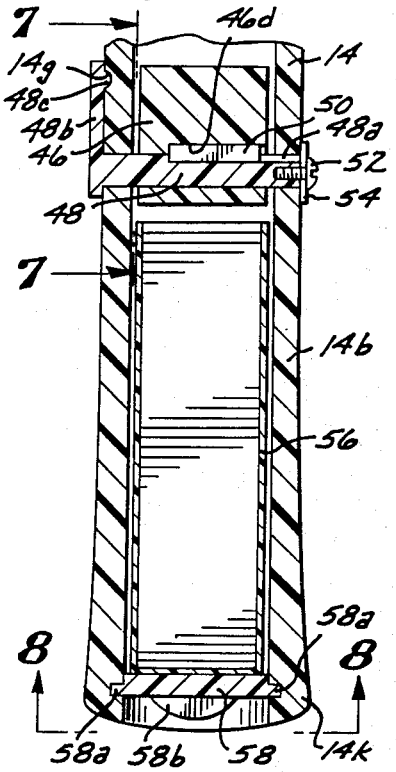
FIG. 7
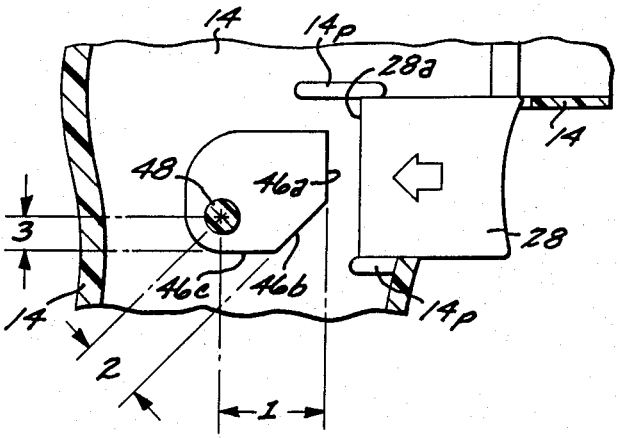
FIG. 8
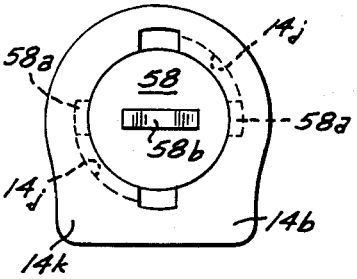
FIG. 10
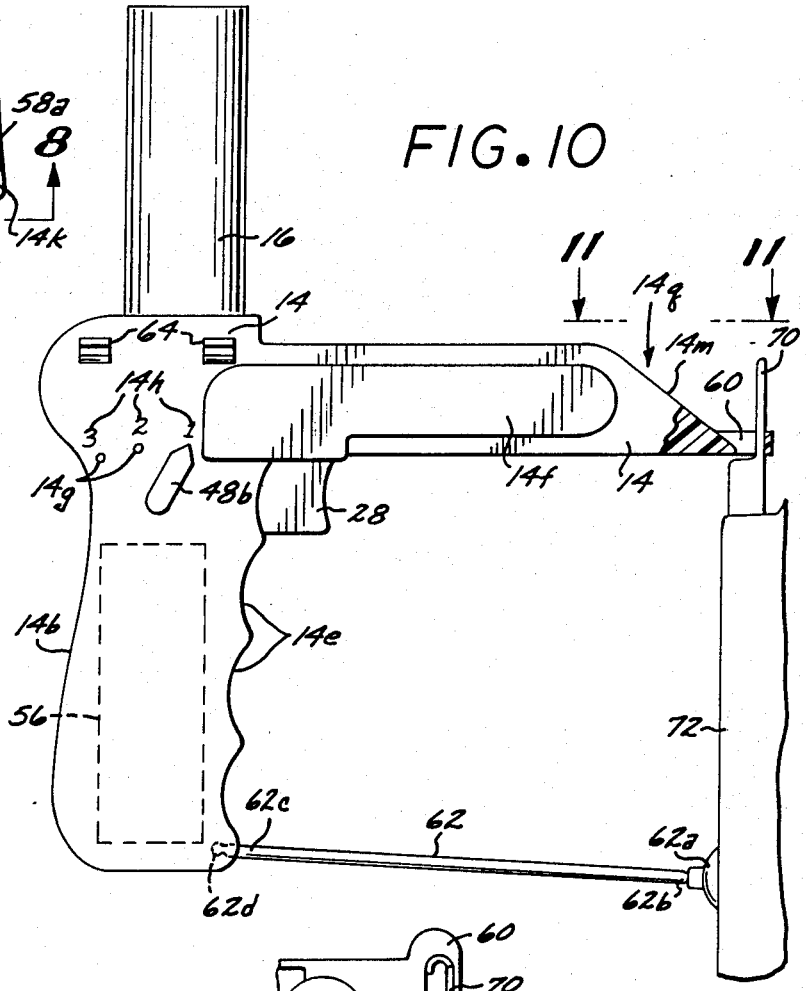
FIG. 9
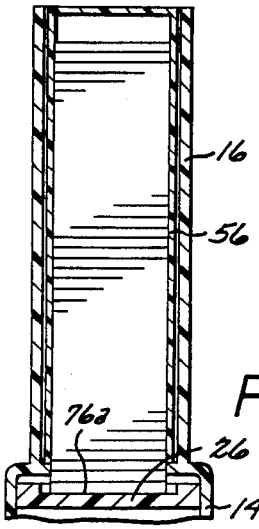
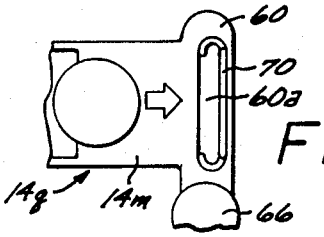
FIG. 11

COIN-DISPENSING APPARATUS

The present invention relates generally to coin-dispensing apparatus, and more particularly, to an apparatus which can be attached to a coin-receiving machine and wherein a single actuation of a manual lever can cause one or more coins to be dispensed into the coin-receiving machine.

BACKGROUND OF THE INVENTION

Today there are a great many different types and styles of machines which receive coins and provide articles or services of virtually any and all descriptions. There are literally thousands of machines which dispense drink or food in response to the receipt of one or more coins, and, in addition thereto, there are many games such as slot machines which receive coins and provide entertainment and the like. Slot machines are particularly popular in certain places which permit gambling, and frequently people will spend long periods of time inserting coins into such machines so as to be entertained. Within recent years, such machines have been so adapted that they take a plurality of coins and thus provide a plurality of activities such as the playing of several games virtually simultaneously, as entertainment. Frequently, such machines cannot be fed coins rapidly enough to maximize the entertainment afforded by the machine, or it is time consuming and cumbersome for the individual or game player to manually insert each coin at the proper time.

OBJECTS OF THE INVENTION

In view of the foregoing, it is an object of the present invention to provide coin-dispensing apparatus which can be actuated to dispense coins into a coin-receiving machine at a relatively fast rate.

Another object of the present invention is to provide coin-dispensing apparatus as characterized above which is shaped like a hand gun and is provided with a trigger such that with a single actuation of such trigger mechanism, one or more coins can be dispensed into a coin-receiving machine.

Another object of the present invention is to provide coin-dispensing apparatus as characterized above which is adapted to be physically associated with the coin-receiving machine such that the single actuation of the manual lever causes the plurality of coins to be dispensed directly into the coin-receiving machine.

A still further object of the present invention is to provide coin-dispensing apparatus as characterized above which comprises a reservoir of coins which are placed in coin receptacles formed in an endless belt such that actuation of the manual lever causes the belt to be advanced, thereby dispensing one or more coins at the outlet of the apparatus.

A still further object of the present invention is to provide coin-dispensing apparatus as characterized above which comprises adjustment means for varying the number of coins which can be dispensed with a single actuation of the manual lever of the apparatus.

A still further object of the present invention is to provide coin-dispensing apparatus as characterized above which comprises fastening means whereby the apparatus can be directly attached to the coin-receiving mechanism of the machine so that the coins can be dispensed rapidly from the apparatus directly into the machine.

An even further object of the present invention is to provide coin-dispensing apparatus as characterized above which includes storage for extra coins for later use in being dispensed by the apparatus.

An even still further object of the present invention is to provide coin-dispensing apparatus which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in combination with the accompanying drawings, in which:

FIG. 6 is a fragmentary sectional view taken substantially along line 6—6 of FIG. 1 of the drawings;

FIG. 7 is a fragmentary sectional view taken substantially along line 7—7 of FIG. 6 of the drawings;

FIG. 8 is a bottom view of the grip of the apparatus, taken substantially along line 8—8 of FIG. 6 of the drawings;

FIG. 9 is a fragmentry sectional view of the reservoir of the apparatus of FIG. 1;

FIG. 10 is a side elevational view of the subject apparatus; and

FIG. 11 is a fragmentary top plan view, taken substantially along line 11—11 of FIG. 10 of the drawings.

Like reference characters indicate corresponding parts throughout the several views of the drawing.

DESCRIPTION OF THE PREFERRED EMBODIMENT

Figure 1:
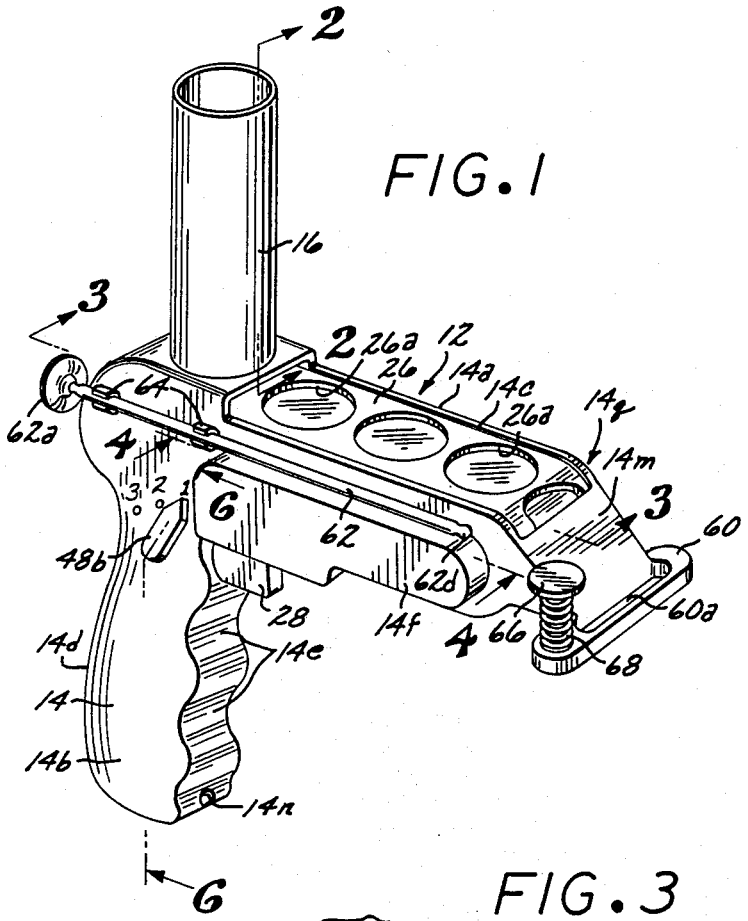
FIG. 1 is a perspective view of coin-dispensing apparatus according to the present invention.
Figure 2:
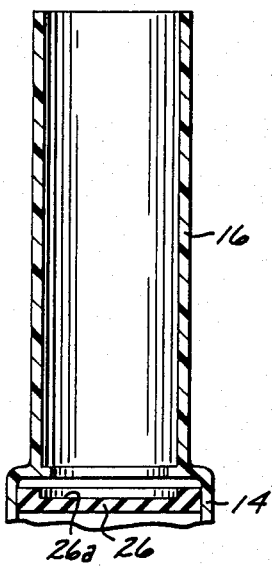
FIG. 2 is a fragmentary sectional view taken substantially along line 2—2 of FIG. 1 of the drawings.

Referring to FIG. 1 of the drawings, there is shown therein apparatus 12 according to the present invention. Such apparatus comprises a main body 14 which may be formed of plastic, metal or the like, in the general shape of a hand gun or pistol such as to have a barrel portion **14*a* and a pistol grip 14*b*. The main body 14 is generally hollow, the barrel portion having an elongated opening 14*c* and the pistol grip 14*b* being formed with a generally curved rear portion 14*d* and finger recesses 14*e* as shown most particularly in FIG. 1**.

Positioned on main body 14 is a coin reservoir 16 which may be separate from the main body or may be formed integrally therewith, and is preferred to be formed of plastic, metal or the like.

Figure 3:
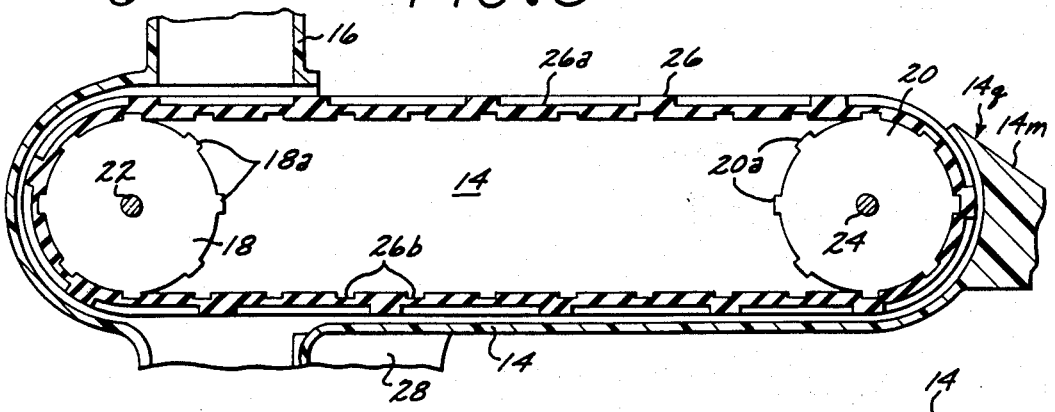
FIG. 3 is a fragmentary sectional view taken substantially along line 3—3 of FIG. 1 of the drawings.
Figure 5:
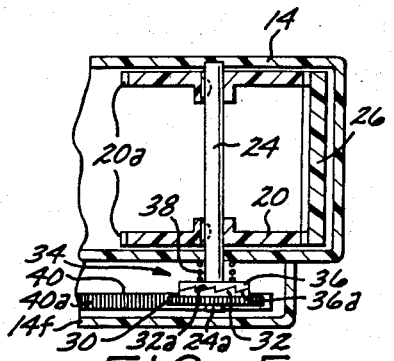
FIG. 5 is a fragmentary sectional view taken substantially along line 5—5 of FIG. 4 of the drawings.

As shown most particularly in FIG. 3 of the drawings, a pair of rollers 18 and 20 are rotatably mounted within the main body 14 on suitable shafts 22 and 24, respectively, which are rotatably mounted in the side walls of such main body 14. Although each of such rollers 18 and 20 may extend the entire width of the interior of main body 14, as shown in FIG. 5, they may each consist of a pair of spaced discs or gears which are firmly secured to the respective shafts 22 and 24, as will hereinafter be explained in greater detail. Rotatably mounted on rollers 18 and 20 is an endless belt 26 which, on its exterior side, is formed with a plurality of spaced coin receptacles or depressions 26*a*, and on the interior side, are formed with a plurality of depressions 26*b*. Such depressions mate with lugs or cogs 18*a* and 20*a* of the rollers 18 and 20, respectively.

As further shown in FIG. 3 of the drawings, the endless belt 26 passes beneath the reservoir 16 of the main body 14 so that coins within the reservoir are fed by gravity into the coin receptacles 26, as will hereinafter become readily apparent.

Figure 4:
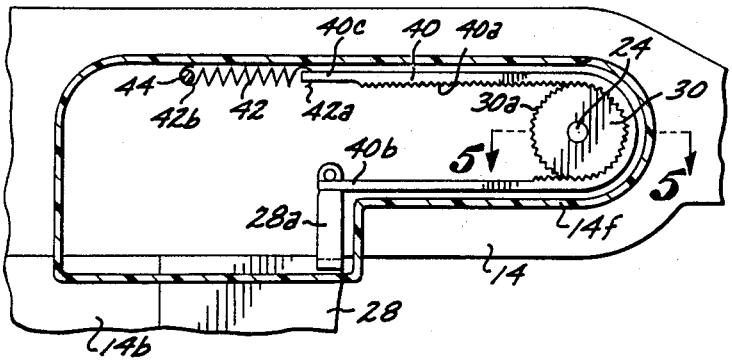
FIG. 4 is a fragmentary sectional view taken substantially along line 4—4 of FIG. 1 of the drawings.

As shown in FIG. 4 of the drawings, the apparatus 12 is provided with a trigger mechanism 28 which is slidably mounted within the main body 14 along a path defined by elongated bosses 14*p* formed in the interior of the side walls of main body 14, as shown in FIG. 7. Trigger mechanism 28 includes an upstanding arm or lever 28*a* which is manually moveable to advance coins on the endless belt to the outlet of the main body 14, to be hereinafter described in detail.

A drive wheel 30 having a serrated peripheral edge 30*a* is rotatably mounted within an extension or housing 14*f* on the side of housing 14. Such drive wheel 30 is mounted on the shaft 24 for rotation thereon, the end 24*a* of such shaft being enlarged or upset so as to prevent such wheel 30 from sliding from shaft 24.

As shown most particularly in FIG. 5 of the drawings, the drive wheel 30 can turn freely on shaft 24, and is attached to a drive member 32 of a clutch or lost motion drive mechanism 34. The drive member 32 and drive wheel 30 are firmly secured to each other or are formed integrally of plastic, metal or the like. The drive member 32 of clutch 34 is provided with a saw tooth surface 32*a* which mates with a complementally-shaped surface 36*a* on a driven member 36 which is also part of the clutch mechanism 34. A compression spring 38 is mounted on shaft 24 between the side wall of housing 14 and the driven member 36.

A drive belt 40 is wrapped about the drive wheel 30, and is formed with a serrated surface 40*a* which, as shown in FIG. 4 of the drawings, mates with the serrated peripheral surface 30*a*. Such drive belt 40 may be formed of any appropriate flexible material such as plastic or the like, and is provided with an end portion 40*b* to be moved with the arm 28*a* on trigger 28. The other end, namely end 40*c* of drive belt 40, is connected to one end 42*a* of a tension spring 42, the opposite end 42*b* of such spring being connected to an anchor pin 44 which is connected to the side wall of main body 14.

As shown in FIG. 7 of the drawings, the movement of trigger 28 within housing 14 is controlled by a cam member 46 which is mounted on a pivot pin 48, the latter of which is anchored in opposite side walls of the main body 14. Such cam member is provided with three limit stop surfaces 46*a*, 46*b* and 46*c*, which are selectively abutted by the surface 28 of trigger 28, as will hereinafter become apparent.

As shown in FIG. 6 of the drawings, the pivot pin 48 is attached to the cam member 46 by means of a key 50 inserted in a keyway formed in aligned slots 48*a* and 46*d*, respectively, to prevent rotational movement between cam 46 and pin 48. Means such as bolt 52 and washer 54 may be employed to suitably anchor the assembled members for rotational movement together within the main body 14.

Pin 48 is provided with an end portion 48*b* in the form of a pointer as shown most particularly in FIGS. 1 and 10 of the drawings, which pointer is adapted with an extension 48*c* for engagement with suitable recesses 14*g*, each of the latter of which is provided with an identifying numeral as shown at 14*h*.

The handle or grip 14*b* of main body 14 is used as a storage space for a coin sleeve or housing 56. In this regard, the pistol grip 14*b* is hollow and is provided with a cap 58 which is formed with a pair of oppositely disposed tabs or ears 58*a* which fit within arcuate slots 14*j* formed in the butt end 14*k* of the grip 14*b*. Such cap 58 is provided with an arcuately-shaped actuating handle 58*b* whereby the coin sleeve 56 can be placed within the hollow interior or cavity of the grip 14*b* and the cap 58 secured in the butt end 14*k*. When it is desired to avail oneself of the coins stored in the grip or handle 14*b*, it is merely necessary to rotate the bayonet mounting of the cap 58 to remove the cap and thereby afford access to the stored coins.

As shown in various figures of the drawings, the main body 14 is formed with an outlet 14*q* which includes an inclined surface 14*m*. As will hereinafter appear in greater detail, as the coins reach the outlet 14*q* of the main body 14, they are caused to slide down the ramp or surface 14*m* under the force of gravity.

An attachment mechanism 60 is provided at the end of inclined surface 14*m* to provide a slot 60*a* which fits over the usual coin-receiving mechanism 70 of a coin-receiving machine 72. As shown in FIG. 10, the usual coin-receiving mechanism of machine 72 is elongated and upstanding so that the mechanism 60 can easily fit thereover to be held in place.

As further shown in FIG. 10 of the drawings, to properly locate the apparatus with respect to the coin-receiving machine 72, a brace 62 may be provided. Such brace comprises a cup-shaped end portion 62*a* which may be a suction cup or the like formed of plastic, rubber or similar material, and which is adjustably mounted on end portion 62*b* of the brace itself. The other end, namely end portion 62*c*, is formed with a generally spherical end 62*d* which is inserted into a detent or opening 14*n* having a clip (not shown) in the lower end of pistol grip 14*b* of main body. For ease of storage and transportating of the entire apparatus 12, a pair of clips 64 are provided on the side of main body 14 for retaining the brace 62 when not in use as above explained.

Since many coin-operated machines are provided with coin-return buttons or pins, for use in the event a coin is jammed or otherwise inoperable in the coin-receiving machine, the mounting mechanism 60 is provided with a button 66 on a shaft which is slideably mounted within the mounting member 60 and includes a return spring 68 whereby the coin-return mechanism can be actuated with the button 66.

The apparatus 12 operates generally as follows: By placing a plurality of coins in the reservoir 16 or within the sleeve 56, as shown in FIG. 9, the lower most coin is caused to bear against the endless belt 26. When a coin receptacle or depression 26*a* is aligned with such lower most coin, further movement of the endless belt transports such coin from the reservoir 16 to the outlet 14*q* of the main body. Such forward motion of endless belt 26 is created by trigger motion of lever or trigger 28. This causes the drive belt 40 to rotate drive wheel 30 so as to cause the mated clutch mechanism 34 to advance the roller 20, the endless belt thereby being moved by virtue of the engagement of cogs 20*a* with depressions 26*b*. The extent of such movement of endless belt 26 is determined by the amount of travel of trigger 28. This is governed by the position of the indicator 48*b* as aligned with either position 1, 2 or 3. If such indicator is in position 1, the cam 46 is as shown in FIG. 7 of the drawings, namely with surface 46*a* limiting the amount of travel of trigger 28. If the indicator 48*b* is in either of the other two positions, namely position 2 or position 3, the permitted travel of trigger 28 is different so that the amount of travel of the belt is varied accordingly. Such positions are indicative of the number of coins which can be dispensed with a single motion of the trigger 28. That is, two coins will be dispensed if the indicator 48*b* is in the position 2 and three coins will be dispensed if such indicator is in position 3.

When the coins reach or approach the outlet 14*q*, the endless belt 26 moves away from the coin, thereby exposing the leading edge of such coins to the inclined surface 14*m*. Further movement of the endless belt causes the coin to be pushed onto such inclined surface and gravity feeds the same into the coin-receiving machine 72.

Upon retraction of the trigger 28 under the influence of tension spring 42, the clutch mechanism 34 prevents reverse movement of belt 26, the inclined surfaces 32*a* and 36*a* of the members 32 and 36 respectively, as well as the compression spring 38 permitting relative movement in such clutch mechanism 34.

It is thus seen that the present invention provides coin-dispensing apparatus which is easy to use and wherein each and every actuation of the lever or trigger causes a predetermined number of coins to be dispensed to a coin-receiving machine. Although I have shown and described certain specific embodiments of my invention, I am well aware that many modifications thereof are possible. The invention, therefore, is not to be restricted except insofar as is necessitated by the prior art and by the spirit of the appended claims.

I claim:

1. Coin-dispensing apparatus comprising, in combination, a main body having a coin outlet and a reservoir of coins, coin transport means to transport coins from said reservoir to said outlet comprising an endless belt having receptacles for coins and being mounted on spaced rollers rotatably mounted on said main body, actuating means for said endless belt including a manual lever on said main body and lost-motion interconnecting means between said lever and one of said rollers including a pair of rotatable discs having mating engaging inclined surfaces, a drive wheel fixed to the drive one of said discs and a flexible belt operable by said lever and having an irregular surface engageable with an irregular peripheral surface on said drive wheel, and means for varying the permitted movement of said actuating lever to thereby control the number of coins dispensed with a single motion of said lever.

2. Coin-dispensing apparatus according to claim 1 wherein the outlet of said main body includes means for attaching said body to a coin-receiving machine.

3. Coin-dispensing apparatus according to claim 2 wherein said attachment means is adapted to provide said coin outlet at the coin inlet of said machine.

4. Coin-dispensing apparatus according to claim 3 wherein said main body has the general shape of a hand gun and said actuating lever is in the form of a trigger.

5. Coin-dispensing apparatus according to claim 4 wherein the outlet of said main body includes an inclined ramp for directing coins from said apparatus to the coin inlet of said machine.

6. Coin-dispensing apparatus according to claim 5 wherein the reservoir is positioned over said endless belt whereby gravity feeds coins from said reservoir into respective receptacles in said belt as the latter is moved by said actuating means.

7. Coin-dispensing apparatus according to claim 6 wherein said rollers are rotatably mounted on individual shafts in said main body, said one of said rollers being formed with means for engaging said endless belt to move the latter with rotation of said one roller.

* * * * *